US005767614A

United States Patent [19]

Fujimura

[11] Patent Number: 5,767,614

[45] Date of Patent: Jun. 16, 1998

[54] CATHODE RAY TUBE HAVING ANNULAR HOLDING MEMBER

[75] Inventor: Takeo Fujimura, Tokyo, Japan

[73] Assignee: Mitsubishi Denki Kabushiki Kaisha, Tokyo, Japan

[21] Appl. No.: 674,730

[22] Filed: Jul. 2, 1996

[30] Foreign Application Priority Data

Oct. 11, 1995 [JP] Japan ..... 7-263123

[51] Int. Cl.[6] ..... H01J 29/48; H01J 29/70

[52] U.S. Cl. ..... 313/414; 313/412; 313/456; 313/459

[58] Field of Search ..... 313/414, 412, 313/417, 416, 438, 456, 459, 460

[56] References Cited

U.S. PATENT DOCUMENTS

| | | | |
|---|---|---|---|
| 3,950,667 | 4/1976 | DeJong et al. | 313/450 |
| 4,728,846 | 3/1988 | Yasuda | 313/451 |
| 4,801,843 | 1/1989 | Mensies | 313/421 |
| 4,855,639 | 8/1989 | Van Eck | 313/456 |
| 4,904,898 | 2/1990 | Penird et al. | 313/449 |
| 5,412,277 | 5/1995 | Chen | 313/414 |
| 5,610,475 | 3/1997 | Chen | 313/414 |

*Primary Examiner*—Ashok Patel

[57] ABSTRACT

A cathode ray tube includes a panel having a fluorescent screen formed on an inner surface thereof, a stem, and a neck between the panel and the stem. An electron gun is supported by a supporting structure in coaxial alignment with the neck. The electron gun has a focusing electrode which includes a first cylinder and a second cylinder having a larger diameter than the first diameter. The first cylinder has a first opening which opens toward the stem and the second cylinder has a second opening which opens toward the panel. A conductive layer is deposited on the inner surface of the cathode ray tube and receives a high voltage. An annular holder is mounted to the supporting structure so that the annular holder surrounds the first cylinder in coaxial alignment with the focusing electrode. The annular holder is a first predetermined radial distance away from the first cylinder and a second predetermined axial distance from second cylinders. A plurality of springs are mounted on the outer circumferential surface of the annular holder. The springs extend to electrically contact the conductive layer and hold the annular holder so that the annular holder is in coaxial alignment with the longitudinal axis of the cathode ray tube.

20 Claims, 9 Drawing Sheets

CATHODE RAY TUBE HAVING ANNULAR HOLDING MEMBER

BACKGROUND OF THE INVENTION

The present invention relates to a cathode ray tube, and more particularly to a cathode ray tube having a large diameter and a good focusing characteristic and a good voltage withstanding characteristic.

A cathode ray tube is a device where electrons emitted from the electron gun are caused to be deflected by an electric field and then impinge on the fluorescent screen to display a visual image.

Electron guns having a focusing lens formed by an electric field, have an inherent problem that the focusing lens deviates from its proper position if the electron gun deviates from its proper position, resulting in poor focusing characteristic. Thus, a variety of improvements have been made in order to prevent positional misalignment of the electron gun.

FIG. 7 illustrates a cathode ray tube having a prior art focusing lens, showing a cutaway view thereof with a partial cross-sectional view. Referring to FIG. 7, the cathode ray tube includes a fluorescent panel 2, funnel 3, neck 4, and stem 5, all being in order from the front side and in one piece construction conventionally formed of glass.

Electrically conductive layer 7 is deposited on the inner surfaces of the neck 4 and the funnel 3. An anode button 8 is made of an electrically conductive material and extends through the funnel to the electrically conductive layer 7. A high voltage is applied as an anode voltage to the electrically conductive layer 7 via the anode button 8, thereby supplying a voltage to the fluorescent screen of the panel 2.

An electron gun 6, which emits an electron beam, is located in the neck 4. The electron gun 6 includes a heater 10, cathode 11, gate 12, gate 13, focusing electrode 14, and high voltage electrode 15. Applying a voltage to both the focusing electrode 14 and the high voltage electrode 15 causes a focusing lens 21 to be formed.

A fixing member 25 includes holders 16 and a plurality of bar-shaped insulators 17. Bar-shaped insulators 17 are made of a special kind of glass. The holders 16 have one ends thereof secured to the various elements of the electron gun 6 and the other ends embedded in the insulators 17, thereby holding the elements of the electron gun 6 in proper, relative positions.

A disc 18 having a through hole in the center is mounted to the tip end portion of the high voltage electrode 15 and a spring 19 electrically connects electrically conductive layer 7 and the disc 18. The voltage applied to the conductive layer 7 is directed via the spring 19 and disc 18 to the high voltage electrode 15. If the spring 19 scratches the conductive layer 7 to reach the glass thereunder, a detrimental gas may escape from the damaged glass. Therefore, the conductive layer 7 in contact with the spring 19 should be made of a material such that the glass forming the neck 4 is not damaged due to the friction between the spring 19 and the conductive layer 7. The glass material contains graphite as a main composition.

The stem lead 20 is planted in the stem 5 and extends through the stem 5 to the rear portion of the electron gun 6. The forward end portion of the stem lead 20 is also planted in the electron gun 6. The spring 19 and stem lead 20 serve to hold the electron gun 6 so that the electron gun 6 lies longitudinally in position relative to the longitudinal axis of the cathode ray tube.

A heater 10 heats the cathode 11, and the cathode 11 emits a beam of electron. The amount of the electron beam current is controlled by a gate 12. The lens, not shown, formed by the gate 12 and gate 13 causes the paths of electrons to converge and to subsequently diverge. The electron path becomes largest in diameter in a gap between the focusing electrode 14 and the high voltage electrode 15. The focusing lens 21 formed by the potential across the gap causes the path to converge toward the panel 2 to make a spot of electrons on the fluorescent screen.

The anode voltage applied to the high voltage electrode 15 is a voltage higher than 20 kV, which is the highest voltage of all the voltages applied to various parts within the cathode ray tube. On the other hand, a voltage of less than one half of the anode voltage is applied to the focusing electrode 14 via the stem lead 20. The focusing electrode 14 is not limited to that shown in FIG. 7 and may be of a type in which a plurality of electrodes are longitudinally arranged between the gate 13 and the high voltage electrode 15 and receive different voltages. Some electrodes may be designed to receive the same voltage as the anode voltage applied to the high voltage electrode 15.

As mentioned above, the focusing electrode 14 may take a variety of forms other than those shown in FIG. 7 depending on focusing method. In this specification, the focusing electrode 14 is referred to as an electrode which receives a voltage lower than the anode voltage and is located closest to the panel 2 of all the electrodes.

In order to display an image with high resolution, the aforementioned cathode ray tubes must have a spot of small diameter formed on the fluorescent screen. One way of obtaining a spot having a small diameter is to increase the diameter of the focusing lens 21. Larger diameters of the focusing lens 21 reduce aberration, thereby resulting in a small diameter spot.

FIG. 8 is a cutaway view of a cathode ray tube equipped with an electron gun 6 of a construction in which a focusing lens defined by applying a voltage has a large diameter. In FIG. 8, the electron gun includes a heater 10, cathode 11, gate 12, gate 13, and focusing electrode 14. The focusing electrode 14 includes a hollow cylinder 14*b* and a hollow cylinder 14*c* positioned forwardly of the hollow cylinder 14*b*. The cylinders 14*b* and 14*c* are arranged in coaxial alignment with each other and are made in one piece construction. The hollow cylinder 14*b* has a small diameter so that the cylinder 14*b* extends through a space surrounded by the insulators 17. The cylinder 14*c* has an opening 14*a* having a diameter slightly smaller than the inner diameter of the neck 4 but larger than the diameter of the cylinder 14*b*. The diameter of the focusing electrode 14 changes stepwise.

The cathode ray tube shown in FIG. 8 has not the high voltage electrode 15 shown in FIG. 7, and therefore the conductive layer 7 deposited on the inner surface of the neck 4 serves as the high voltage electrode 15. Thus, a voltage applied to the conductive layer 7 and the opening 14*a* defines a focusing lens 21 forwardly of the opening 14*a*. The diameter of the focusing lens 21 is almost the same as the inner diameter of the neck 4, so that the design parameters of the other elements of the electron gun 6 may be selected appropriately to make full use of the diameter of the focusing lens 21, thereby reducing aberration.

The springs 19 are mounted on an appropriate positions on the focusing electrode 14 and extend rearwardly of the opening 14*a*. The free ends of the springs 19 resiliently engage the inner surface of the neck 4.

The aforementioned prior art construction presents the following drawbacks. One drawback is creeping discharge along the inner surface of the neck 4 between the spring 19 and the conductive layer 7. With the aforementioned cathode ray tube having a conventional focusing lens with a large diameter as shown in FIG. 8, a considerable difference in potential exists between the focusing electrode 14 and the conductive layer 7. In addition, one end of the springs 19 are close to the edge of the conductive layer 7 and are in contact with the inner surface of the neck 4 to hold the forward portion of the electron gun 6 in position. This proximity presents a greater possibility of discharge between the focusing electrode 14 and the conductive layer 7.

The neck 4 is made of glass 7 which inherently has a possibility of creeping discharge. In addition, the smooth and straight inner surface of the neck 4 increases possibility of creeping discharge. The springs 19 are merely in contact with the inner surface of the neck 4 and therefore, the springs frictionally can move along the inner surface of the neck 4, scratching the surface when external vibration is transmitted to the springs 19. Scratching the surface causes a small amount of gas to escape from the glass into the cathode ray tube, the gas leading to unstable phenomena which may trigger dielectric breakdown. Such phenomena may be prevented by allowing the springs 19 to contact the neck 4 at locations as close to the rear end of the cathode ray tube as possible. However, such arrangement is disadvantageous in that the electron gun 6 cannot be properly held at the forward end portion thereof.

Another drawback is the relative position between the forward end portion of the electron gun 6 and the neck 4. A cathode ray tube having a large-diameter focusing lens utilizes the springs 19 to hold the focusing electrode 14 in such a way that the electron gun 6, particularly the focusing electrode 14, is coaxial with the longitudinal axis of the cathode ray tube, or that the opening 14*a* is coaxial with the neck 4.

The electron gun 6 is generally constructed so as to be coaxial with the focusing electrode 14. Thus, the springs 19 hold the focusing electrode 14 which is the forward end portion of the electron gun 6, and the stem lead 20 holds the rear end portion of the electron gun 6 in position, thereby holding the electron gun 6 coaxial with the cathode ray tube.

Since the focusing lens 21 is formed between the focusing electrode 14 and the conductive layer 7, it is important that the focusing electrode 14 is accurately coaxial with the neck 4. Thus, the springs 19 must be made of a stiff, resilient material, for example, stainless steel and designed to provide sufficient pressure against the inner surface of the neck 4. However, the springs 19 made of, for example, stainless steel are apt to scratch the inner surface of the neck 4, causing a gas to escape from the glass of the neck 4. The gas increases the possibility of creeping discharge. A worst case is that the cathode ray tube is damaged.

Even if the conductive layer 7 is not provided on the neck 4 in the proximity to the focusing electrode 14, it is not desirable in terms of withstanding voltage that the neck 4 is close to the focusing electrode 14 to which a voltage different from the anode voltage is applied. The diameter of the opening 14*a* may be made smaller as shown in FIG. 9 so that the focusing electrode 14 is not close to the inner surface of the neck 4. In FIG. 9, the springs 19 must radially extend a longer distance from the electron gun 6, the amount of deflection of the spring 19 significantly varying from spring to spring in the same electron gun. The variations of deflection of the focusing electrode 14 result in poor coaxial alignment of the focusing electrode 14 with the neck 4, which in turn causes distortion of the focusing lens 21 leading to increased variations of focusing characteristic. This arrangement also provides a smaller diameter of the focusing lens 21.

The closer to the panel 2 the springs 19 contact the inner surface of the neck 4, the more free the electron gun 6 is from vibration. However, the closer to the panel 2 the springs 19 are, the closer to the conductive layer 7 the springs 19 are. This is not desirable in terms of withstanding voltage. Allowing the springs 19 to contact the inner surface at positions close to the stem 5, eliminates the possibility of discharge between the springs 19 and the conductive layer 7 but makes it difficult to maintain true coaxial relation of the forward end portion of the electron gun 6 with the neck. In other words, it is difficult to maintain true coaxial relation of the electron gun 6 with the neck 4 while maintaining other characteristics including withstanding voltage.

SUMMARY OF THE INVENTION

The present invention was made in view of the the aforementioned technical drawbacks, and an object of the invention is to provide a cathode ray tube where the opening 14*a* is coaxial with the neck 4 while maintaining other good characteristics, particularly withstanding voltage.

A cathode ray tube includes a panel having a fluorescent screen formed on an inner surface thereof, a stem, and a neck between the panel and the stem. An electron gun is supported by an insulating supporting structure in coaxial alignment with the neck and positioned between the panel and the stem. The electron gun has a focusing electrode with a first cylinder and a second cylinder having larger diameter than the first diameter. The first cylinder has a first opening which opens toward the stem and the second cylinder has a second opening which opens toward the panel. A conductive layer is deposited on the inner surface of the cathode ray tube and receives a high voltage. An annular holder is mounted to the supporting structure so that the annular holder surrounds the first cylinder in coaxial alignment with the focusing electrode. A plurality of springs are mounted on the outer circumferential surface of the annular holder. The springs extend to electrically contact the conductive layer and hold the annular holder so that the annular holder is in coaxial alignment with he longitudinal axis of the neck.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

The invention will be described by way of the following embodiments.

First embodiment

Figure 1A:
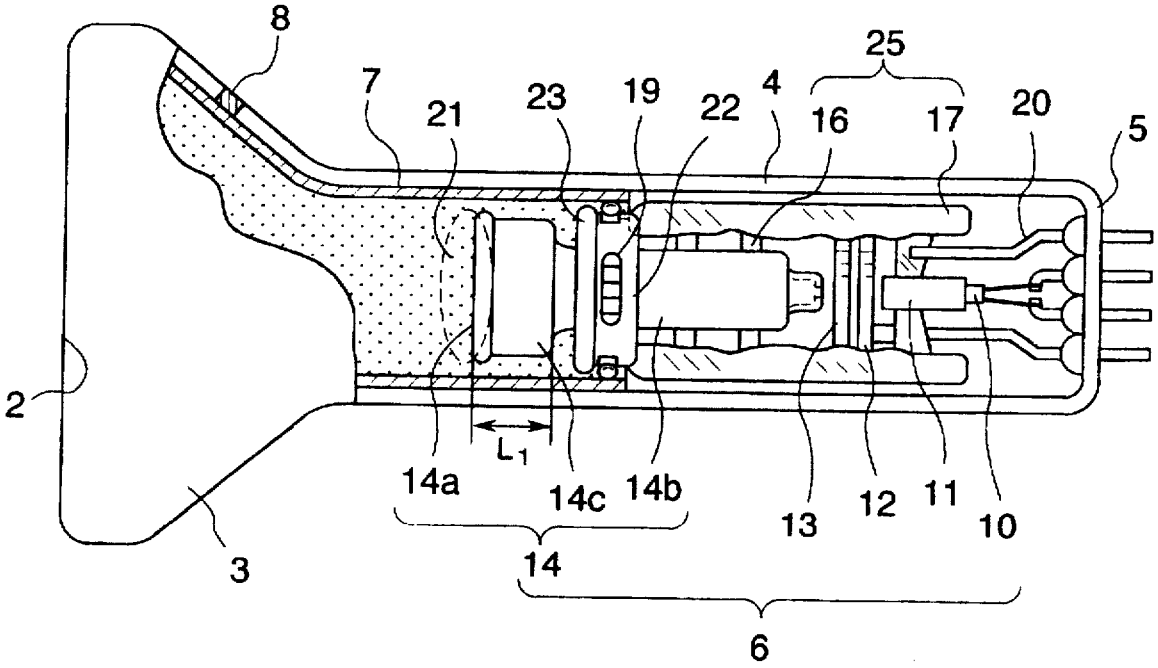
FIG. 1A is a side view, partly cut away, of a cathode ray tube of a first embodiment of the invention.

FIG. 1A is a side view, partly cut away, of a cathode ray tube of a first embodiment of the invention. Referring to FIG. 1A, the cathode ray tube includes a panel 2 having a fluorescent screen on the inner surface thereof, funnel 3 continuous with the panel 2, neck 4 continuous with the funnel 3, and the stem 5 connected to the neck 4, all being generally made of glass. The panel 2 is at the forward end of the cathode ray tube 2 and the stem 5 is at the rearward end. An electrically conductive layer 7 is deposited on the inner surface of the funnel 3 and the neck 4. The conductive layer 7 extends toward the stem 5 at least beyond the large diameter cylinder 14*c*. The electron gun 6 has a heater 10, cathode 11, gate 12, gate 13, and focusing electrode 14. The focusing electrode 14 is located in the neck 4 at a forward end of the electron gun 6 and has an opening 14*a* having a diameter smaller than the inner diameter of the neck 4. Applying a voltage to the focusing electrode 14 and the conductive layer 7 defines a focusing lens 21 adjacent the openings 14*a*. The focusing electrode 14 includes a small diameter cylinder 14*b* and a large diameter cylinder 14*c* in one piece with the small diameter cylinder 14*b*. The small diameter cylinder 14*b* has a diameter so that the small diameter cylinder 14*b* is allowed to extend through a space surrounded by insulators 17 located rearwardly of the focusing electrode 14. The large diameter cylinder 14*c* has an opening 14*a* with a diameter larger than that of the smaller cylinder 14*b* but smaller than the inner diameter of the neck 4. The diameter of the focusing electrode 14 changes stepwise from the small diameter cylinder to the large diameter cylinder. The small diameter cylinder 14*b* is coaxial with the large diameter cylinder 14*c*. Applying a voltage to the conductive layer 7 and the focusing electrode 14 causes a focusing lens 21 to be formed forwardly of the opening 14*a*.

An annular holder 22 is made of metal such as stainless steel, and in the shape of a ring having an outer diameter slightly smaller than the inner diameter of the neck 4 and larger than the outer diameter of the small diameter cylinder 14*b*. The radial distance between the inner diameter of the annular holder 22 and the outer diameter of the small diameter cylinder 14*b* is such that there is no possibility of discharging between the annular holder 22 and the small diameter cylinder 14*b*. The annular holder 22 is axially away from the large diameter cylinder 14*c* such that there is no possibility of discharge between the annular holder 22 and the large diameter cylinder 14*c*.

The annular holder 22 has a curl 23 which is outwardly folded over the outer circumferential surface of the annular holder 22 into a generally toroidal shape. The curl 23 prevents electric field between the focusing electrode 14 and the annular holder 22 from being concentrated, thereby maintaining a good withstanding voltage characteristic between the annular holder 22 and the focusing electrode 14.

A plurality of springs 19 are secured to the outer circumferential surface of the annular holder 22 by, for example, welding, and are made of, for example, stainless steel. The springs contact the conductive layer 7 while resiliently deflecting in the plane perpendicular to the longitudinal axis of the electron gun 6. The conductive layer 7 extends toward the stem so that the end portion of the conductive layer 7 surrounds at least a part of the small diameter cylinder 14*b*.

Figure 2:
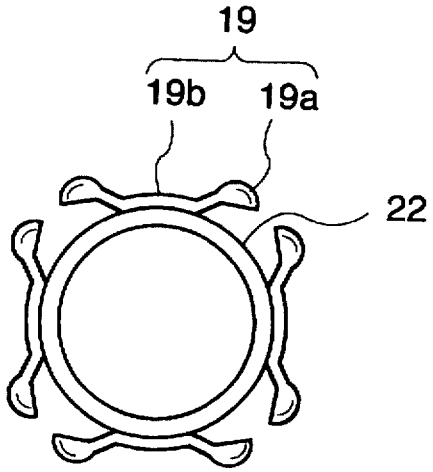
FIG. 2 shows the springs as being mounted to the annular holder.

FIG. 2 shows the springs 19 as being mounted to the annular holder 22. The spring 19 has a spoon-shaped contact 19*a* with a convex surface at each free end thereof and is welded at a middle portion 19*b* thereof to the circumferential outer surface of the annular holder 22. The springs 19 extend and deflect in the plane perpendicular to the longitudinal axis of the electron gun 6 so that the contacts 19*a* are in resilient contact with the rearward end portion of the conductive layer 7.

Figure 1B:
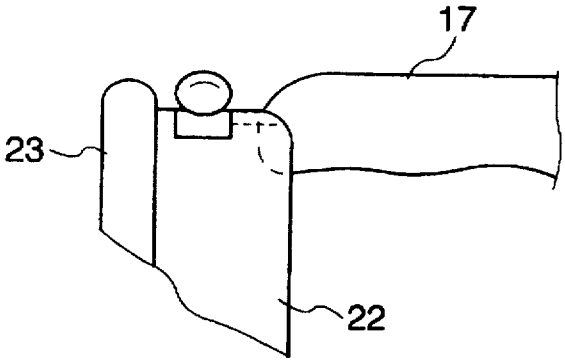
FIG. 1B is a fragmentary expanded view of the cathode ray tube in FIG. 1A.

The springs 19 are previously welded to the annular holder 22 using an appropriate jig, not shown. The focusing electrode 14 has holders 16 planted therein at predetermined positions of the small diameter cylinder 14*b*. The holders 16 and the rearward end of the annular holder 22 are embedded in the insulators 17 as shown in FIG. 1B so that the structural elements of the electron gun 6 including the annular holder 22 are held in position by means of the insulators 7 when assembling the cathode ray tube.

In the first embodiment, the springs 19 receive the same voltage as the anode voltage since the springs 19 are in contact with the conductive layer 7. This construction eliminates the need to design the distance between the conductive layer 7 and the springs 19 such that discharge will not occur therebetween, as opposed to the prior art cathode ray tube shown in FIG. 8.

The springs 19 do not contact the glass but the conductive layer 7 conventionally formed of graphite, eliminating the possibility of damaging the glass. This construction eliminates a drawback of decreased withstanding voltage across the creeping distance due to instability of the glass surface in the prior art.

Applying the same voltage to the annular holder 22 and conductive layer 7 will not result in any adverse effects, eliminating the need to take into account creepage discharge. This allows the annular holder 22 to have an outer diameter as close to the inner diameter as possible of neck 4. Thus, the spring 19 preferably extends only a short radial distance from the axis of the electron gun 6, eliminating variation of deflection which is considerable in the case of long springs 19. The shorter length of extension of the springs 19 minimizes eccentricity of the focusing electrode 14 with respect to the neck 4, ensuring minimum variations in focusing characteristic.

Figure 8:
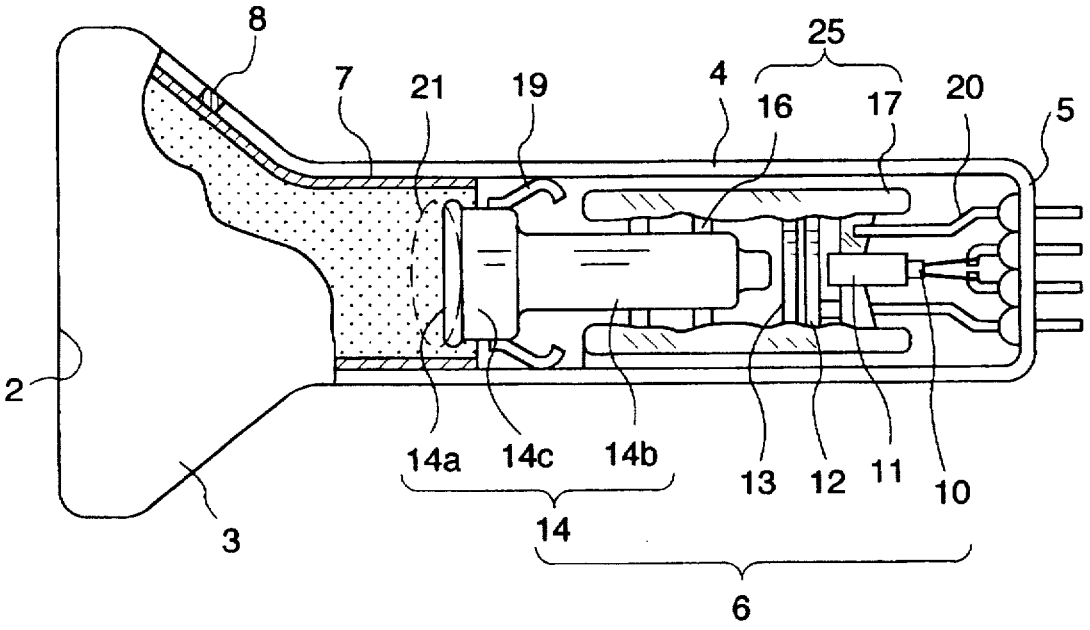
FIG.8 PRIOR ART
FIG. 8 is a cutaway view of a cathode ray tube equipped with an electron gun of a construction in which a focusing lens defined by applying a voltage has a large diameter.
Figure 9:
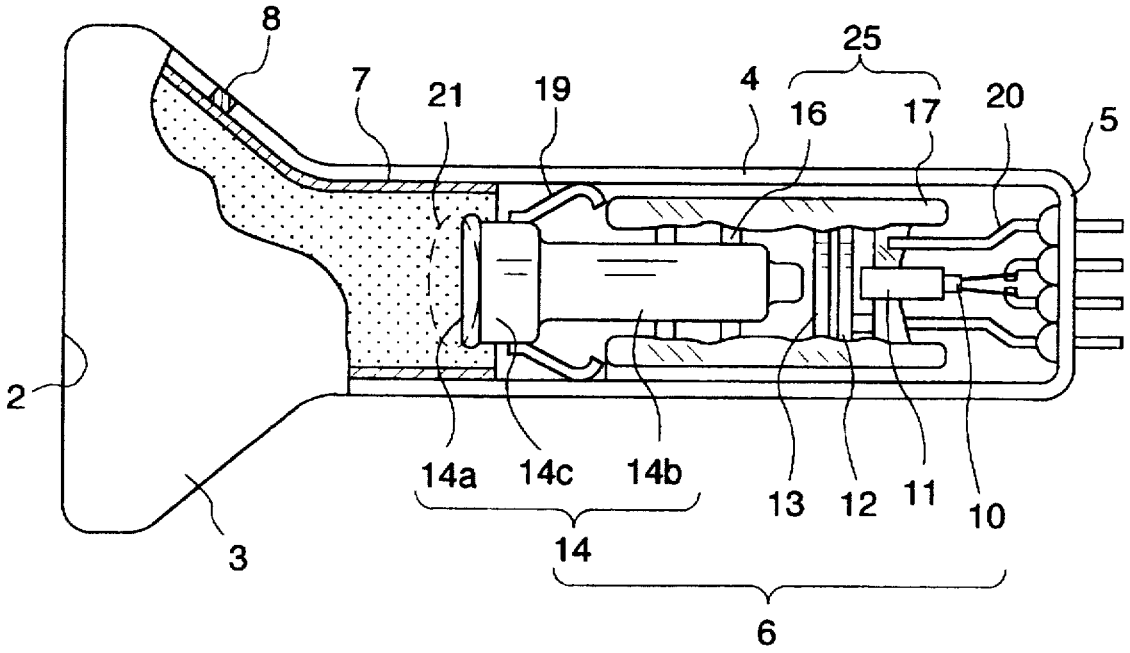
FIG.9 PRIOR ART
FIG. 9 shows smaller diameter of the opening of the focusing electrode.

The aforementioned construction greatly eliminates the prior art difficulties described with reference to FIGS. 8–9, while also ensuring other characteristics such as withstand voltage characteristic.

Throughout the described embodiments of the invention, the anode voltage applied to the conductive layer 7 reaches rearward part of the cathode ray tube including an area surrounding the focusing electrode 14. This indicates that the anode voltage is applied to a larger area than that shown in FIG. 7. This may seem to be detrimental to the withstanding voltage characteristic. However, the technology of electron guns has been established where an anode voltage is applied in such a way that the anode voltage surrounds the focusing electrode.

However, if the springs 19 rearwardly extend in the direction parallel to the axis of the electron gun 6, the conductive layer 7 also needs to further extend rearwardly or the annular holder 22 needs to be mounted closer to the stem 5, resulting in poor withstanding voltage characteristic of the cathode ray tube. In the first embodiment, the springs 19 extend in the plane perpendicular to the longitudinal axis of the electron gun 6. Such arrangement allows the springs 19 to have a shorter length in axial direction. Further, the conductive layer 7 only needs to rearwardly extend as far as the plane in which the springs 19 extend. This allows the conductive layer 7 to terminate as close a location to the panel 2 as possible, resulting in a minimum area of the conductive layer 7 to which the anode voltage is applied.

The annular holder 22 has a circular cross section at a part thereof where the springs 19 are mounted. This circular cross section minimizes positional error when mounting the springs 19 and therefore provides improved coaxial relation of the annular holder 22 with the focusing electrode 14.

Second embodiment

Figure 3:
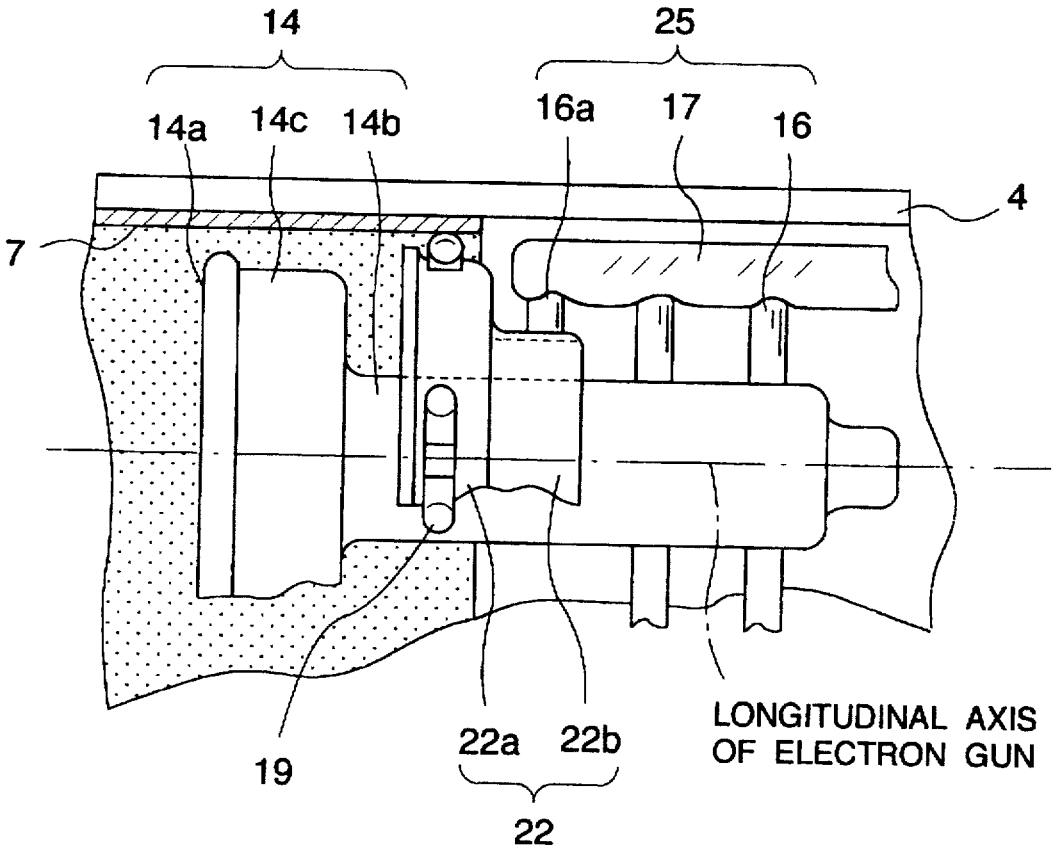
FIG. 3 illustrates a part of a cathode ray tube according to a second embodiment.

FIG. 3 illustrates a part of a cathode ray tube according to a second embodiment. Referring to FIG. 3, the annular holder 22 includes a third and a fourth cylinders **22*a* and 22*b*. The third cylinder 22*a* has an outer diameter slightly smaller than the inner diameter of the neck, and the fourth cylinder 22*b* has an outer diameter smaller than the large diameter cylinder 22*a* but much larger than the small diameter cylinder 14*b*. The third and fourth cylinders 22*a* and 22*b* are in one piece construction and in coaxial alignment with each other. The cylinder 22*a* is closer to the panel 2 than the cylinder 22*b* and has the springs 19 which are in contact with the conductive layer 7. The holders 16*a* have one end thereof extending into the cylinder 22*b* and, for example, welded thereto, and the other ends embedded in the insulators 17, so that the other electrodes including the focusing electrode 14** maintain their relative positions.

The insulators 17 are usually made of a special kind of glass. When assembling, the electron gun 6 and the annular holder 22 are first held in a predetermined positional relation using, for example, a jig, not shown. Then, using a conventional technique, the insulators heated to red hot are pressed against the holders 16 and **16*a* and are quickly cooled down, so that the holders 16 and 16*a* are simultaneously embedded in the insulators 17**.

Figure 7:
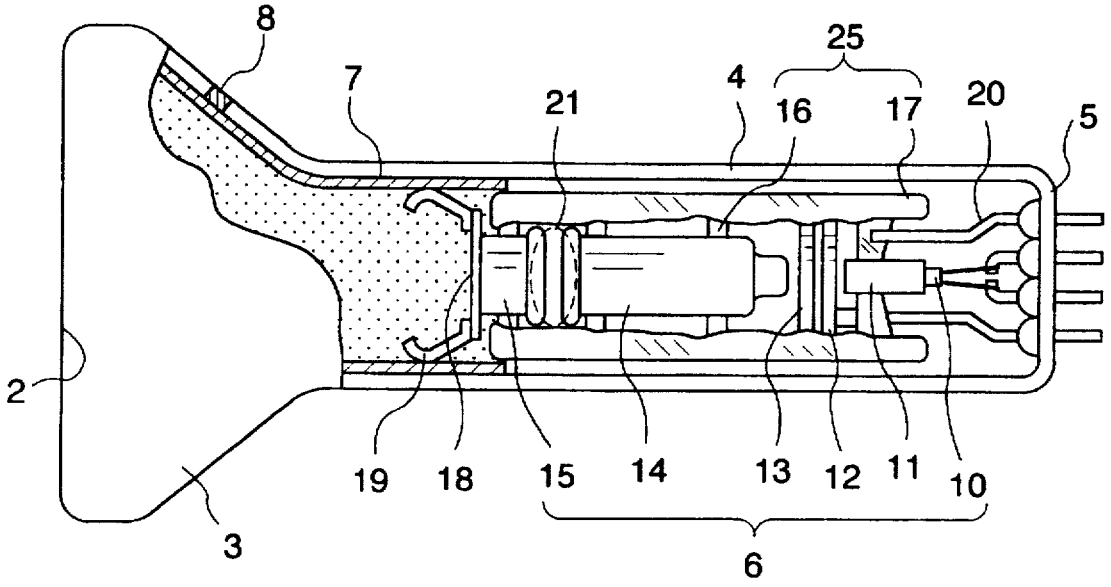
FIG.7 PRIOR ART
FIG. 7 illustrates a cathode ray tube having a prior art focusing lens, showing a cutaway view thereof with a partial cross-sectional view.

Since the diameter of the cylinder **22*b* is smaller than that of the cylinder 22*a*, short holders 16*a* may conveniently be embedded in insulators 17, while still allowing the insulators to be in place within the neck 4. Holders 16 and 16*a* projecting radially from the electron gun 6 allow the annular holder 22 to be assembled to the insulators 17 in the same process as the prior art holders 16 in FIGS. 7–9 are assembled to the insulators 17**.

The outer diameter of the cylinder **22*a* only slightly smaller than the inner diameter of the neck 4 results in less deflection of the springs 19** when assembled into the cathode ray tube, improving coaxial relation of structural elements of the electron gun.

Third embodiment

Figure 4:
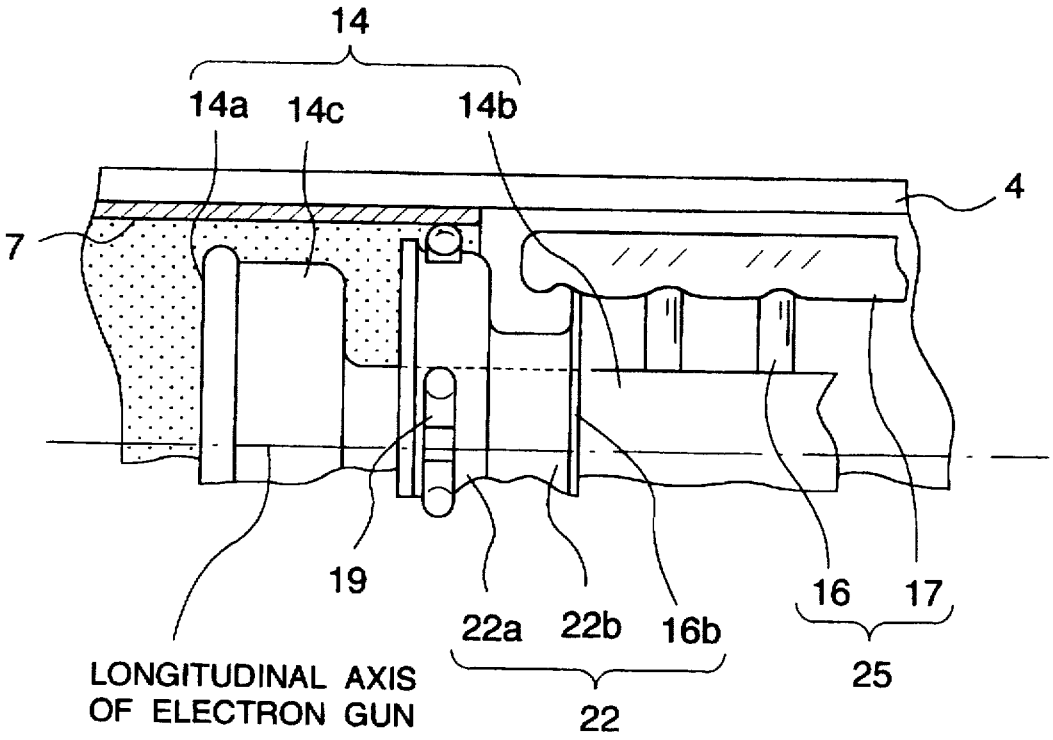
FIG. 4 illustrates an essential part of a cathode ray tube according to a third embodiment.

FIG. 4 illustrates an essential part of a cathode ray tube according to a third embodiment. Referring to FIG. 4, the small diameter cylinder **22*b* of the annular holder 22 has a flange 16*b* which radially outwardly extends all around the small diameter cylinder 22*b*. The flange 16*b* has an outer edge thereof embedded in the insulators 17**.

The aforementioned construction eliminates the holders **16*a* shown in FIG. 3, simplifying the construction and reducing the manufacturing cost. The flange 16*b* of the small diameter cylinder 22*b* also serves to alleviate concentration of electric field between small diameter cylinder 22*b* and the focusing electrode 14**.

Fourth embodiment

The first to third embodiments are of the construction in which the diameter of the focusing electrode 14 changes stepwise along the longitudinal axis of the electron gun 6.

The diameter of the opening **14*a*** is preferably as large as possible in terms of aberration of a focusing lens.

If the large diameter cylinder **14*c* is shorter in axial length, then opening 14*a* is closer to the small diameter cylinder 14*b*. A short axial length of the large diameter cylinder 14*c* disturbs the distribution of electric field, resulting in a smaller effective diameter of the focusing lens 21 formed by the electric field. On the other hand, if the large diameter cylinder 14*c* extends closer to the stem 5, the annular holder 22 must accordingly be mounted closer to the stem 5, resulting in poor coaxial relation of the opening 14*a* with the axis of the cathode ray tube, i.e., the neck 4. Therefore, it is difficult to simultaneously maintain both coaxial relation of the opening 14*a*** with the cathode ray tube and withstand voltage characteristic of the cathode ray tube.

Even if the large diameter cylinder **14*c* has a reasonable axial length, the large diameter cylinder 14*c* and the annular holder 22 must be axially spaced apart by a predetermined distance so that a sufficient withstand voltage characteristic is maintained. Therefore, the annular holder 22 cannot be mounted closer to the large diameter cylinder 14*c*** than a certain distance.

The cathode ray tube according to the fourth embodiment provides a solution to this drawback. The fourth embodiment is characterized in that the large diameter cylinder **14*c* is provided with a funnel-shaped portion having a diameter continuously changing along the longitudinal axis of the electron gun 6. This construction allows the annular holder 22 to be placed still closer to the opening 14*a***.

Figure 5:
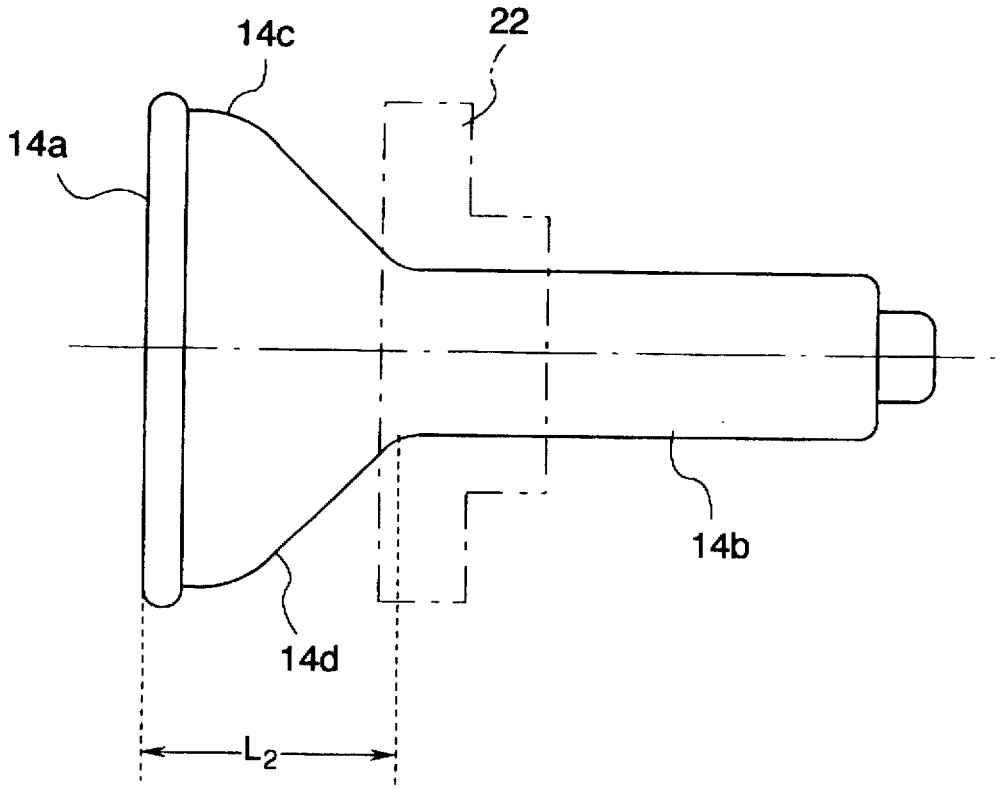
FIG. 5 illustrates an essential part of a cathode ray tube according to a fourth embodiment.

FIG. 5 illustrates an essential part of a cathode ray tube according to the fourth embodiment. Referring to FIG. 5, the focusing electrode 14 has a large diameter cylinder **14*c*, funnel-shaped portion 14*d*, small diameter cylinder 14*b* in order. The large diameter cylinder 14*c* has an opening 14*a* that opens toward the panel 2. The small diameter cylinder 14*b* extends along the axis of the cathode ray tube. The funnel-shaped portion 14*d* extends between the large diameter cylinder 14*c* and the small diameter portion 14*b*. The diameter of the funnel-shaped portion 14*d* varies continuously from the diameter of the large diameter cylinder 14*c* to the diameter of the small diameter cylinder 14*b* along the axis of the electron gun 6. The annular holder 22 extends over the funnel-shaped portion 14*d* so that the forward end portion of the annular holder 22 surrounds a part of the funnel-shaped portion 14*d* near the small diameter cylinder 14*b*. The large diameter cylinder 14*c*, funnel-shaped portion 14*d*, and small diameter cylinder 14*b* may be in one piece construction. The distance L2 from the opening 14*a* to the rear end of the funnel-shaped portion 14*d* is equal to the distance from the opening 14*a* to the large diameter cylinder 14*c* in FIG. 1A**.

The construction of the fourth embodiment allows the annular holder 22 to be positioned closer to the panel 2 than prior art cathode ray tubes. Therefore, the springs 19 contact the conductor layer 7 at a distance closer to the panel 2, improving coaxial relation of the opening 14*a* with the axis of the cathode ray tube while maintaining as good withstand voltage characteristic as the first to third embodiments. In other words, the construction maintains not only withstand voltage characteristic but also coaxial relation of the opening 14*a* with the axis of the cathode ray tube.

Fifth embodiment

As mentioned in the first embodiment, the conductive layer 7 is made of graphite so that the conductive layer 7 and the neck 4 made of glass are not damaged by the springs 19 mechanically contacting the conductive layer 7, or by the voltage applied to the conductive layer. However, the graphite is disadvantageous in that free graphite particles may be developed in an area of the conductive layer 7 in proximity to the plane in which the opening 14*a* lies. The free graphite particles, if deposited on the focusing electrode 14, tend to cause stray emission which in turn deteriorates display quality. The fifth embodiment is to solve the problem.

Figure 6:
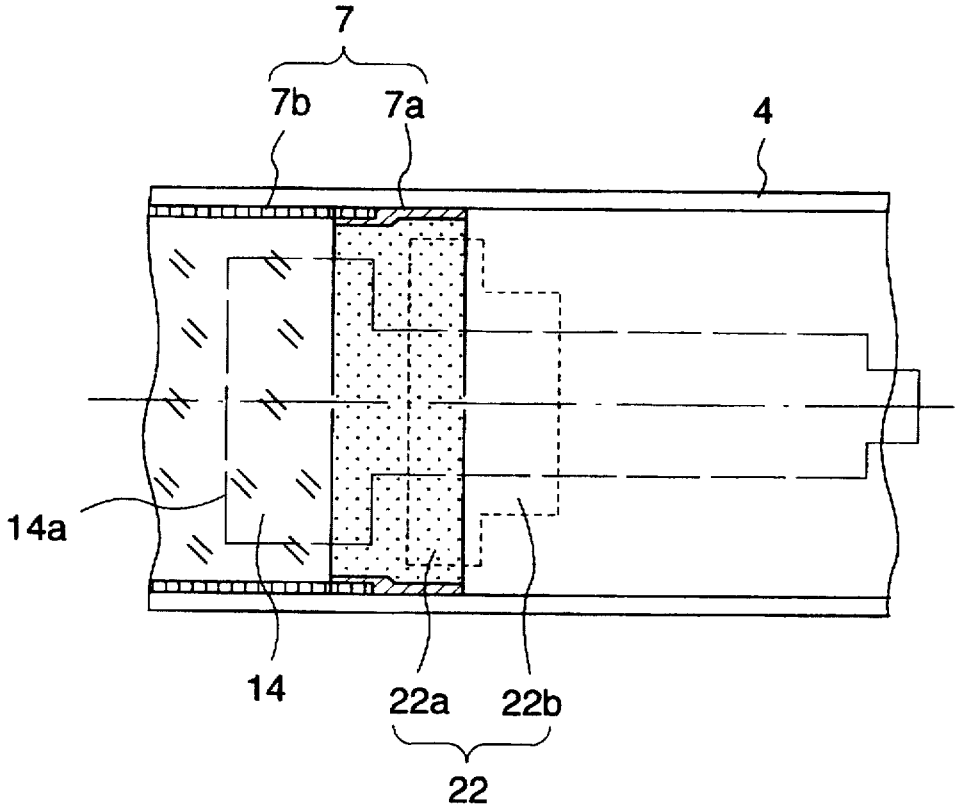
FIG. 6 illustrates an essential part of a cathode ray tube according to the fifth embodiment.

FIG. 6 illustrates an essential part of a cathode ray tube according to the fifth embodiment. The conductive layer 7 includes a thin protective layer 7*a* made primarily of graphite, and a thin metal layer 7*b* such as aluminum which suppresses development of free graphite particles. The conductive layer 7*a* is located at the reward end of the metal layer 7*b* and contacts the spring 19, not shown, welded to the cylinder 22*a*. It is to be noted that the metal layer 7*b* extends rearwardly to surround the opening 14*a* and the protective layer 7*a* made of graphite does not surround the opening 14*a*.

The springs 19, not shown, mounted on the annular holder 22 contact the protective layer 7*a*, and therefore the protective layer 7*a* is formed primarily of graphite so that the neck 4 made of glass and conductive layer 7 are not damaged due to the physical contact of the springs 19 and electrical energizing. The metal layer 7*b* is made of a material which withstands high voltages and does not cause free graphite particles to be developed.

The protective layer 7*a* serves to protect the neck 4 from damages due to mechanical contact with the springs 19 and voltage application through the spring 19, while the metal layer 7*b* surrounding the opening 14*a* prevents free graphite particles and undesired stray emission.

The metal layer 7*b* is preferably formed by metal vapor deposition and aluminum vapor deposition is particularly preferred. Aluminum is preferred because aluminum is a material that suppresses development of free particles. A layer called "aluminum back" is conventionally formed on the inner surface of cathode ray tube behind the panel 2, not shown, by vapor deposition of aluminum. Therefore, this aluminum layer may be extended to the neck 4 to form the metal layer 7*b*.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claims is:

1. A cathode ray tube, comprising:

a neck having a longitudinal axis;

an electron gun having a focusing electrode with a first cylinder and a second cylinder having a larger diameter than said first cylinder, said first and second cylinders being in coaxial alignment with each other, said first cylinder having an opening which axially opens in a first direction and said second cylinder having an opening which axially opens in a second direction opposite to the first direction;

a conductive layer deposited on an inner surface of said neck;

an annular holder through which said first cylinder extends, said annular holder being supported so that said annular holder is in coaxial alignment with said first and second cylinders, said annular holder having an opening in the second direction and behind the opening of said second cylinder; and a plurality of springs mounted on an outer circumferential surface of said annular holder, said springs extending to contact said conductive layer and holding said annular holder in position so that said annular holder is in coaxial alignment with said neck.

2. The cathode ray tube according to claim 1, wherein said plurality of springs extends in a plane perpendicular to a longitudinal axis of said neck.

3. The cathode ray tube according to claim 1, wherein said annular holder opens toward said second cylinder with an end portion thereof outwardly folded into a generally toroidal shape.

4. The cathode ray tube according to claim 1, wherein said conductive layer includes an aluminum layer and a protective layer electrically continuous with said aluminum layer, said aluminum layer surrounding one opening of said second cylinder and said protective layer being in contact with said plurality of springs.

5. The cathode ray tube according to claim 1, wherein said annular holder is fixed to said electron gun by insulating members.

6. The cathode ray tube according to claim 1, wherein each of said plurality of springs is substantially strip-shaped, each spring is fixed at a mid portion thereof to said annular holder and extends away from said annular holder, and each spring has two free ends each of which has a convex surface in contact with said inner wall of said neck.

7. The cathode ray tube according to claim 1, wherein said annular holder includes a large diameter cylinder opening in the second direction and a small diameter cylinder coaxial with said large diameter cylinder and opening in the first direction, said large diameter cylinder being connected to said small diameter cylinder.

8. The cathode ray tube according to claim 7, wherein said annular holder further includes a plurality of holders welded to said small diameter cylinder, said holders being connected to said electron gun by insulating members.

9. The cathode ray tube according to claim 7, wherein said small diameter cylinder opens in said first direction with an end portion thereof outwardly bent into a radially extending flange, and said flange being fixed at an outer edge thereof to said electron gun by insulating members.

10. The cathode ray tube according to claim 1, wherein said second cylinder has a diameter continuously decreasing with increased distance from the opening of said second cylinder.

11. The cathode ray tube according to claim 10, wherein said annular holder extends over said second cylinder so that said annular holder surrounds a part of said second cylinder near said first cylinder.

12. A cathode ray tube comprising:

a neck having a longitudinal axis;

an electron gun positioned in said neck, said electron gun having a focusing electrode to which a voltage is applied;

an annular holder positioned in said neck and being in coaxial alignment with said neck, said focusing electrode extending through said annular holder, said annular holder receiving a voltage different from the voltage applied to said focusing electrode; and a plurality of springs mounted on an outer circumferential surface of said annular holder, said springs extending to contact an inner surface of said neck and holding said annular holder in coaxial alignment with said neck.

13. A cathode ray tube according to claim 12, wherein each of said plurality of springs has a middle portion which is mounted on said annular holder and two spoon shaped contact portions which extend to contact an inner surface of said neck.

14. A cathode ray according to claim 12, further comprising:

a conductive layer on an inner surface of said neck, said conductive layer contacting said plurality of springs.

15. A cathode ray tube according to claim 14, wherein said conductive layer includes a thin protective layer and a thin metal layer.

16. A cathode ray tube according to claim 15, wherein said thin protective layer is made primarily of graphite.

17. A cathode ray tube according to claim 15, wherein said thin metal layer is made of aluminum.

18. A cathode ray tube according to claim 12, wherein said annular holder includes an end portion which is folded outward.

19. A cathode ray tube comprising:

a neck having a longitudinal axis;

an electron gun positioned in said neck, said electron gun having a focusing electrode to which a voltage is applied;

an annular holder positioned in said neck and being in coaxial alignment with said neck, said focusing electrode extending through said annular holder, said annular holder receiving a voltage different from the voltage applied to said focusing electrode; and an insulator surrounding a portion of said focusing electrode, wherein said annular holder has a flange member which radially extends outward, an outer edge of said flange member being embedded in said insulator.

20. A cathode ray tube comprising:

a neck having a longitudinal axis;

an electron gun positioned in said neck, said electron gun having a focusing electrode to which a voltage is applied; and an annular holder positioned in said neck and being in coaxial alignment with said neck, said focusing electrode extending through said annular holder, said annular holder receiving a voltage different from the voltage applied to said focusing electrode;

wherein said focusing electrode includes a large diameter cylinder and a small diameter cylinder coaxially arranged with and attached to said large diameter cylinder, and wherein said large diameter cylinder has a funnel shaped portion, said annular holder extending over part of said funnel shaped portion of said large diameter cylinder.

* * * * *